US010654692B2

(12) United States Patent
Norton et al.

(10) Patent No.: US 10,654,692 B2
(45) Date of Patent: May 19, 2020

(54) SYSTEM AND METHOD FOR REMOTE CRANE OPERATIONS ON OFFSHORE UNIT

(71) Applicant: Rowan Companies, Inc., Houston, TX (US)

(72) Inventors: Richard Norton, Houston, TX (US); Agung Atus Sundia, Katy, TX (US)

(73) Assignee: Rowan Companies, Inc., Houston, TX (US)

( * ) Notice: Subject to any disclaimer, the term of this patent is extended or adjusted under 35 U.S.C. 154(b) by 0 days.

(21) Appl. No.: 15/971,028

(22) Filed: May 4, 2018

(65) Prior Publication Data

US 2019/0337771 A1 Nov. 7, 2019

(51) Int. Cl.

| | |
|---|---|
| ***B66C 13/04*** | (2006.01) |
| ***E21B 47/12*** | (2012.01) |
| ***E21B 15/02*** | (2006.01) |
| ***B66C 23/52*** | (2006.01) |

(52) U.S. Cl.

CPC ..... *B66C 13/04* (2013.01); *B66C 23/52* (2013.01); *E21B 15/02* (2013.01); *E21B 47/122* (2013.01)

(58) Field of Classification Search

CPC combination set(s) only.
See application file for complete search history.

(56) References Cited

U.S. PATENT DOCUMENTS

| | | | |
|---|---|---|---|
| 6,825,763 B2 | 11/2004 | Ulrich et al. | |
| 7,916,024 B2 | 3/2011 | Gennard | |
| 9,914,624 B2 * | 3/2018 | Fulton | B66C 13/46 |
| 2009/0008351 A1 * | 1/2009 | Schneider | B66C 13/063 212/272 |
| 2010/0089855 A1 | 4/2010 | Kjolseth | |
| 2011/0309931 A1 | 12/2011 | Rose | |
| 2012/0130632 A1 | 5/2012 | Bandyopadhyay et al. | |

(Continued)

FOREIGN PATENT DOCUMENTS

| | | |
|---|---|---|
| AU | 2015200877 B2 | 3/2015 |
| CN | 101661094 A | 8/2008 |
| WO | 2013/033780 A1 | 3/2013 |

OTHER PUBLICATIONS

Extronics, "Personnel & Asset Tracking," Brochure, obtained from www.extronics.com, dated Mar. 2012.

(Continued)

*Primary Examiner* — Kyle O Logan
(74) *Attorney, Agent, or Firm* — Fletcher Yoder, P.C.

(57) ABSTRACT

A system and computer-implemented method is used for operating a crane on an offshore unit on which entities (e.g., personnel and/or equipment) operate. A dimensional map of the unit is created so locations of the entities can be tracked in the dimensional map of the unit. For example, wireless monitoring is received from wireless devices associated with both the entities and the offshore unit to perform the tracking. Dynamic operating parameters of the crane are also obtained while the crane is operating on the unit. These parameters can be received remotely from the crane. A programmable control device calculates a lifting zone that moves dynamically in the dimensional map based on the parameters, detect a conflict of a tracked location interfering with the zone, and outputs the detected conflict for appropriate action.

21 Claims, 9 Drawing Sheets

(56) References Cited

U.S. PATENT DOCUMENTS

| | | | | |
|---|---|---|---|---|
| 2013/0065577 | A1* | 3/2013 | Ceresoli | B66C 13/48 455/419 |
| 2013/0299440 | A1* | 11/2013 | Hermann | B66C 13/46 212/276 |
| 2014/0340220 | A1 | 11/2014 | Meraz | |
| 2015/0133748 | A1 | 5/2015 | Edmonds et al. | |
| 2015/0158704 | A1* | 6/2015 | Giles | B66C 13/06 212/273 |
| 2017/0293290 | A1* | 10/2017 | Flir | G05B 19/41865 |
| 2019/0071289 | A1* | 3/2019 | Mayer | B66C 15/045 |

OTHER PUBLICATIONS

Accuware, "Accuware Bluetooth Beacon Tracker," Fact Sheet, obtained from www.accuware.com, copyright 2017.
Accuware, "Accuware Sentinel," Fact Sheet, obtained from www.accuware.com, copyright 2017.
Accuware, "Accuware Wi-Fi Locations Monitor," Fact Sheet, obtained from www.accuware.com, copyright 2015.
Offshore, "Aramco Claims World First for Offshore Personnel Tracking," obtained from www.offshore-mag.com, dated Mar. 14, 2016.
Gao, "RFID Personnel Tracking System," obtained from http://gaorfid.com/people-locating-rfid-system/, undated, downloaded on Feb. 28, 2018.
Aanderaa Data Instruments AS, "MIPEG Crane Safety and Monitoring Systems," Brochure, dated Apr. 2013.
Ritchie, M., "Automated Personnel on Board Muster System (Automated Emergency Roll Call)," White Paper, Marine Rescue Technologies, dated Apr. 19, 2010.
Identec Solutions, "Watcherpersonnel: Visibility of Onshore and Offshore Operations Delivers Safety and Productivity," obtained from https://www.identecsolutions.com/oil-gas-industry-solutions/watcher-personnel-people-tracking/, undated, downholed on Feb. 28, 2018.
Extronics, "iCAM100 Compact Fixed Focus CCTV Camera," Brochure, copyright 2016, 2-pgs.
Extronics, "Wireless Technologies take Personnel Safety in the Process Industries to a New Level," White Paper, dated Oct. 2010, 7-pgs.
Extronics, "iVID101 Explosion Proof Video Monitor," Brochure, copyright 2016, 2-pgs.
Extronics, "iRFID100 Fixed Zone 1 UHF RFID Reader," Brochure, copyright 2016, 2-pgs.
Extronics, "iTAG100 Intrinsically Safe Tag," Brochure, copyright 2016, 4-pgs.
Extronics, "iTAG101 Tag Exciter," Brochure, copyright 2016, 3-pgs.
Extronics, "Extronics Advance," Product Catalogue, dated May 25, 2017, 32-pgs.
Extronics, "Hardware Manager," Brochure, copyright 2015, 1-pg.
Extronics, "MobileView enterprise visibility software," Brochure, copyright 2016, 3-pgs.
Extronics, "Instant Notifier v1.5," Brochure, copyright 2016, 2-pgs.
Extronics, "T2 Wi-Fi Active RFID Tag ," Brochure, copyright 2016, 2-pgs.
Extronics, "T2-EB Wi-Fi Active RFID Tag ," Brochure, copyright 2016, 2-pgs.
Extronics, "T3 Wi-Fi Active RFID Tag ," Brochure, copyright 2016, 2-pgs.
Extronics, "EX3210 Tag Exciter," Brochure, copyright 2016, 2-pgs.
Extronics, "Tag & Exciter Detector (TED)," Brochure, copyright 2016, 2-pgs.
Extronics, "T2L Wi-Fi Active RFID Tag," Brochure, copyright 2016, 2-pgs.
Extronics, "T14 Bi-Directional Worker Badge," Brochure, copyright 2016, 2-pgs.
Extronics, "T2s Small Form Factor Tag," Brochure, copyright 2016, 2-pgs.
Extronics, "EX5210R Rugged Long Range Outdoor Tag Exciter," Brochure, copyright 2019, 2-pgs.
Omni-ID Ltd, "Omni-ID(R)", Brochure, copyright 2016, 2-pgs.
Extronics, "Evaluation Development Kit," Brochure, copyright 2018, 3-pgs.

* cited by examiner

SYSTEM AND METHOD FOR REMOTE CRANE OPERATIONS ON OFFSHORE UNIT

BACKGROUND OF THE DISCLOSURE

On an offshore drilling rig or other platform, a number of personnel may be performing different functions at various locations. At the same time, equipment may be moved, and various operations may be conducted in various areas on the platform. One piece of equipment commonly used on a platform is a crane, which is used for lifting and moving equipment (e.g., pipe stands, generators, wellhead components, etc.) on the platform, unloading supply vessels, and the like. As will be appreciated, being able to identify and track personnel in real time during operations of a crane or other equipment on the platform can be very useful.

The subject matter of the present disclosure is directed to overcoming, or at least reducing the effects of, one or more of the problems set forth above.

SUMMARY OF THE DISCLOSURE

According to the present disclosure, a computer-implemented method operates a crane on an offshore unit on which entities operate. A dimensional map (e.g., two or three-dimensional map) of the offshore unit is created in a database, and locations of the entities are tracked in the database in the dimensional map of the offshore unit by receiving at least wireless monitoring from wireless devices associated with both the entities and the offshore unit. A programmable control device obtains dynamic operating parameters of the crane operating on the offshore unit and calculates a lifting zone moving dynamically in the dimensional map in the database based on the dynamic operating parameters of the crane. The programmable control device detects a conflict of at least one of the tracked locations interfering with the dynamically moving lifting zone of the crane and outputs the detected conflict.

In receiving at least the wireless monitoring from the wireless devices associated with both the entities and the offshore unit, indication of the entities can be received from portable ones of the wireless devices associated with the entities at one or more of a plurality of stationary ones of the wireless devices associated with the offshore unit.

Tracking can involve receiving visual monitoring from visual devices associated with the offshore unit and can involve identifying given ones of the entities as authorized and unauthorized for the tracked locations in the dimensional map.

To obtaining the dynamic operating parameters, the programmable control device can select the crane for remote operation from a plurality of cranes on the offshore unit and can restrict operation of any other of the cranes for simultaneous operation. The control of the crane can received from an operator (e.g., from a remote location), and feedback can be received from equipment of the crane. The dynamic movement of the crane relative to the dimensional map can then be determined from the received control and feedback. In general, the dynamic movement of the crane can include one or more of slew angle, boom angle, boom length, hook load, weight, block height, boom limit, slew limit, overload, hoist speed, cable length, boom angle speed, slew angle speed, and environmental data. In this situation, calculating the lifting zone can involve dimensionally translating the dynamic movement of the crane into one or more boundaries of the lifting zone within the dimensional map.

To obtain the dynamic operating parameters, visual monitoring at least in a vicinity of the crane operating on the offshore unit can also be received so the dynamic movement of the crane relative to the dimensional map can be determined from the received visual monitoring.

The programmable control device can detect the conflict of at least one of the tracked locations interfering with the dynamically moving lifting zone of the crane operating on the offshore unit by determining that the at least one tracked location is located at a point-in-time within a boundary of the dynamically moving lifting zone in the dimensional map. The programmable control device can output the conflict by generating a perceptible representation of the conflict and outputting the perceptible representation from an interface of the programmable control device to an operator of the crane. The programmable control device can also generate a control in response to the conflict and can control the operation of the crane with the generated control.

According to the present disclosure, a system for operating a crane on an offshore unit on which entities operate comprises a plurality of portable wireless devices, a plurality of stationary wireless devices, a database, a communication interface, and a programmable control device. The portable wireless devices are associated with the entities, and the stationary wireless devices are associated with the offshore unit. The database stores a dimensional map of the offshore unit, and the communication interface is in communication with the plurality of stationary wireless devices and with the crane.

The programmable control device is in communication with database and the communication interface. The programmable control device is configured to: track, in the database, locations of the entities in the dimensional map of the offshore unit by receiving at least wireless monitoring from the wireless devices associated with the entities and the offshore unit; obtain dynamic operating parameters of the crane operating on the offshore unit; calculate a lifting zone moving dynamically in the dimensional map in the database based on the dynamic operating parameters of the crane; detect a conflict of at least one of the tracked locations interfering with the dynamically moving lifting zone of the crane; and output the detected conflict.

The system can further comprises a plurality of visual devices associated with the offshore unit, the visual devices receiving visual monitoring and in communication with the interface. In this case, the programmable control device can be configured to track, in the database, the locations of the entities in the dimensional map of the offshore unit based on the received visual monitoring. The programmable control device can also determine dynamic movement of the crane relative to the dimensional map from the received visual monitoring at least in a vicinity of the crane operating on the offshore unit.

The can include an operator module in communication with the interface and receiving control of the crane from an operator. A crane module in communication with the interface can receive feedback from equipment of the crane. To calculate the dynamically moving lifting zone in the dimensional map, the programmable control device can thereby determine dynamic movement of the crane relative to the dimensional map from the received control and feedback, and can dimensionally translate the dynamic movement of the crane into one or more boundaries of the lifting zone within the dimensional map.

The foregoing summary is not intended to summarize each potential embodiment or every aspect of the present disclosure.

DETAILED DESCRIPTION OF THE DISCLOSURE

Figure 1:
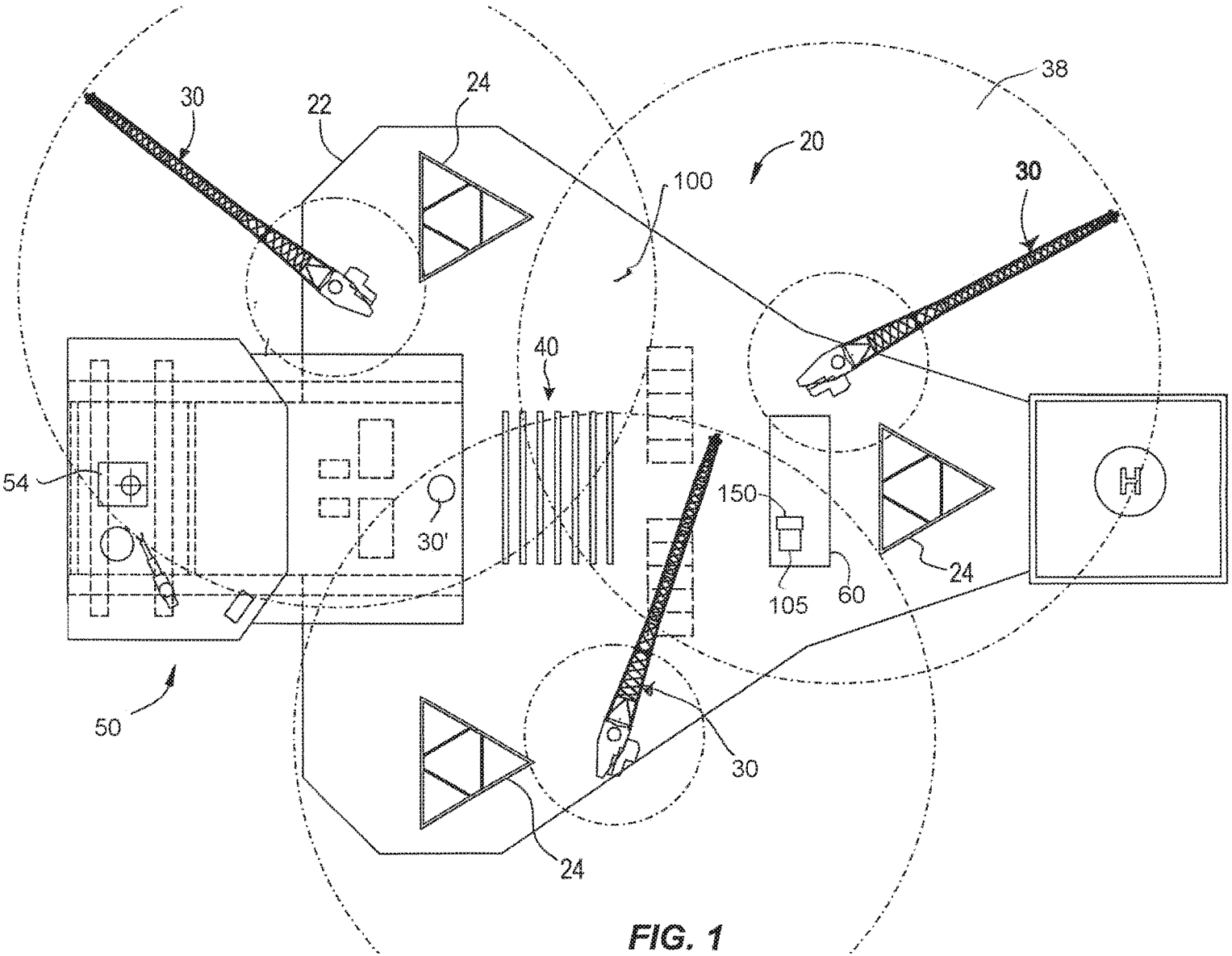
FIG. 1 illustrates a plan view of an offshore unit having cranes for remote operation according to the present disclosure.

FIG. 1 illustrates a plan view of an offshore unit 20 having cranes 30 for remote operation according to the present disclosure. Although shown here as a jack-up rig, the offshore unit 20 may be configured as a floating, fixed, or semi-submersible rig, vessel, barge, platform, mobile offshore drilling unit (MODU), mobile offshore production unit (MOPU), and the like according to various embodiments.

The offshore unit 20 includes a hull or platform 22 supported by a plurality of extendable and retractable legs 24 and equipped with a plurality of cranes 30 to assist with moving and supporting equipment to conduct various rig operations. The unit 20 may also be equipped with various facilities, including a control room 60, as well as any auxiliary equipment necessary to operate offshore.

The offshore unit 20 can include a tower 54 equipped to conduct operations, such as drilling, completions, logging, decommissioning, workover, and other offshore operations. The tower 56 can be movable relative to the vessel's hull 22 in both forward and aft directions by a cantilever assembly 50. In general, the unit 20 can include other equipment, such as BOP handling equipment, swarf skip equipment, a knuckle boom crane 30', fluid handling equipment, pipe racks 40, and the like.

The cranes 30 can rotate, extend, retract, lift, and lower their booms for moving equipment, pipe, and the like on the unit 20 and between the unit 20 and other vessels (not shown). The cranes 30 operate within an operable range or static lifting area 38 schematically outline here.

To control and monitor the crane operations, the unit 20 includes a control system 100 having a central control unit 105 and having a number of elements incorporated into components and locations on the unit 20 and its equipment. Also as part of the control and monitoring of the crane operations, a remote crane station 150 is provided in the control room 60 of the unit 20 or elsewhere. Alternatively or in addition, each crane 30 can have a local crane cabin.

Figure 2A:
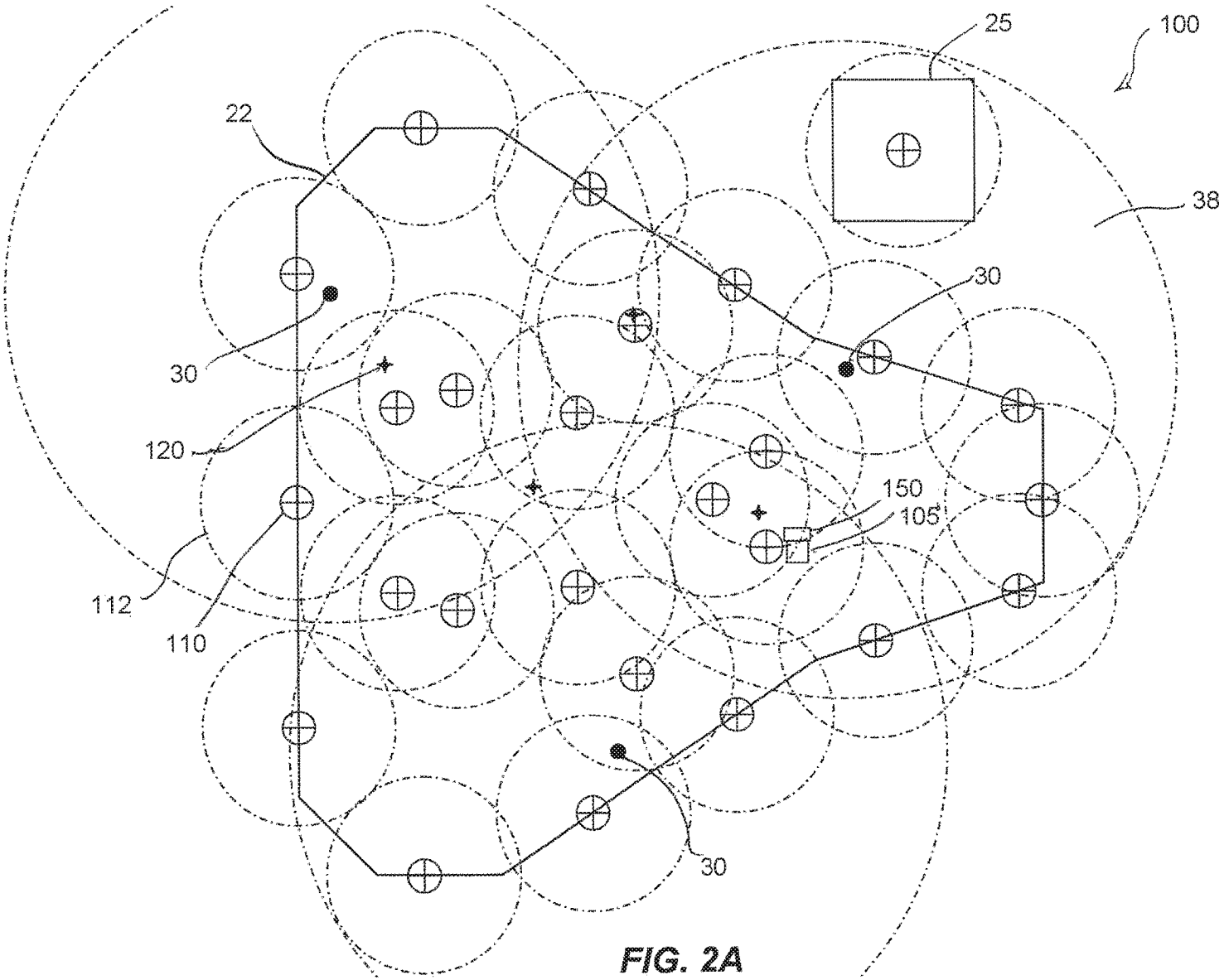
FIG. 2A diagrams a plan view of stationary wireless devices according to the present disclosure arranged on the offshore unit.

As shown in FIG. 2A, the control system 100 includes a plurality of stationary wireless devices 110 according to the present disclosure arranged on the offshore unit 20. The stationary wireless devices 110 can be arranged in any suitable layout, preferably having overlapping wireless regions 112 to cover the unit 20 (or at least suitable zones of the unit 20). Although shown here in a plan, two-dimensional arrangement, the stationary wireless devices 110 can be arranged in three-dimensions. Even a separate vessel 25 or the like may be outfitted with such stationary wireless device(s) 110.

Overall, the locations of the stationary wireless devices 110 are predefined and are used to produce a static dimensional layout of the unit 20. Although the dimensional layout can produce a two-dimensional map, the layout can also produce a three-dimensional map. The dimensional map can cover the entire (or near entire) area of the unit 20. Alternatively, one or more static areas can be digitally laid out in the map with a fixed set of coordinates that represents a potential location of possible on-board lifting operations.

The map at least includes the static lifting areas 38 of the cranes 30 electronically mapped in Cartesian or other coordinates within the predefined array of stationary devices 110. This static area represents where the crane 30 could potentially conduct lifting operations. Survey, global positioning system, and other such information can be used in producing the location information (e.g., x, y, z coordinates) for the layout and map.

In conjunction with the stationary wireless devices 110, the control system 100 further includes a plurality of portable wireless devices 120, which are associated with entities on the unit 20. The entities can be personnel, equipment, or the like located on the platform 22. Typically, the entities of interest according to the present disclosure will include those that may move on the platform 22. For example, portable wireless devices 120 can be associated with personnel who operate on the unit 20. Portable wireless devices 120 can also be associated with equipment and other components that may be movable on the unit 20. For example, fork lifts, the retractable legs, components on the cantilever assembly 50, other cranes 30, and the like may also have portable wireless devices 120 installed or attached to them. (For simplicity, reference herein may be to personnel, although this should be taken to mean any suitable entity for tracking on the unit 20.)

Using the wireless devices 110, 120, entities (e.g., personnel and/or equipment) are located and identified within the electronic map of the unit 20 (e.g., at least in static lifting areas 38). As discussed below, the portable devices 120 can include radio-frequency identification (RFID) or Bluetooth tags mounted on personnel hard hats, worn on outer clothing on personnel in some fashion, affixed to movable equipment on the unit 20, etc. Additionally, the control system 100 can functionality identify the personnel (or equipment) as authorized or unauthorized for one or more particular areas of the unit 20. Other categories could also be used.

Figure 2B:
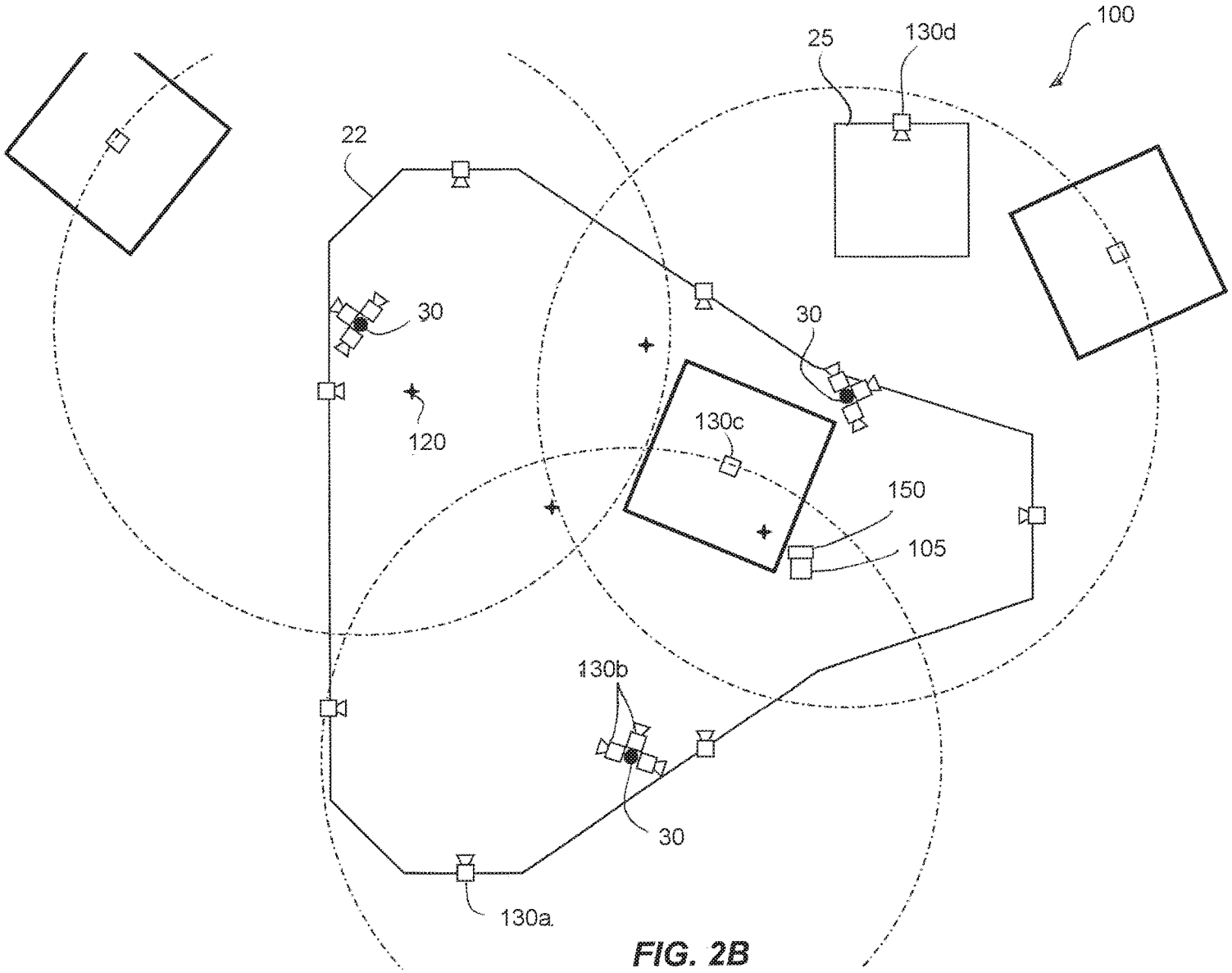
FIG. 2B diagrams a plan view of optical devices according to the present disclosure arranged on the offshore unit.

In addition to the wireless devices 110, 120, the control system 100 can further include a plurality of optical devices arranged on the offshore unit 20. For example, FIG. 2B diagrams a plan view of various optical devices 130 (i.e., 130*a, b, c, d*, etc.) arranged on the offshore unit 20. The optical devices 130 can include cameras, motion detectors, or the like. For example, the devices 130 can be pan-tilt-zoom (PTZ) cameras.

As with the wireless devices (110, 120), some of the optical devices 130*a* may be arranged in a stationary layout on the unit 20 to monitor various zones, regions, and areas of the unit 20. Other the optical devices 130*b-c* may be arranged to move on or relative to the unit 20. For example, optical devices 130*b* can be associated with the cranes 30 to provide a number of moving camera feeds of the vicinity around the crane 30. The booms of the cranes 30 may be fitted with an optical device 130*c* in the form of a down-facing camera to provide a camera feed of the unit 20 beneath the boom and any load carried. Even a separate vessel 25 or the like may be outfitted with optical device(s) 130*d*.

In addition to providing camera feeds for the operation of the cranes 30, the network of optical devices 130 can provide visual recognition of personnel or equipment on the unit 20. The visual recognition of personnel in addition to the output of their X-Y coordinate can be used by the control system 100 to determine authorization of the personnel to access defined areas of the unit 20.

According to one arrangement, the control system 100 uses a combination of the wireless and optical devices 110, 120, and 130 installed across potential areas exposed to lifting operations. These areas are mapped digitally in coordinates across the potential static areas 38 that could be exposed to lifting operations. For example, based on the wireless and optical monitoring of the unit 20 from the layout of the wireless and optical devices 110, 120, and 130, the unit 20 can be modelled as a dimensional map 200, such as shown in a plan view in FIG. 3A and in a perspective view in FIG. 3B. The dimensional map 200 includes a coordinate system 210, such as Cartesian coordinates or polar coordinates, although other systems could be used. Even a separate vessel or the like may include coordinate mapping 215. Mapped locations 220 of the personnel (or equipment) can be determined in the coordinate system 210 of the map 200 using monitoring and tracking provided by the wireless and optical devices (110, 120, and 130). Features of the crane 30 can also be located in the coordinate system 210 of the map 200 using information provided by the crane's operation and the operator's controls. As schematically shown here, the features of the crane 30 can include the pedestal 232, the boom 234, the boom end 236, motion range 238, and load 240, which can be mapped.

Crane instrumentation can deliver real-time location of the load 240 and the crane boom 234 as defined by coordinates in the static lifting area 238. The crane information is used to create a dynamic lifting zone 250 defined in the map 200. As shown, the dynamic lifting zone 250 can be moved dynamically in the map 200 with the operation of the crane 30. The dynamic lifting zone 250 can have any desirable boundaries and can define a region taken up by the crane's boom 234 and load 240, a region in which the crane's boom 234 and load 240 is moving, a buffer area about such regions, and other such boundaries.

Overall, the dynamic lifting zone 250 can be the area moving under the boom 234 and its load 240. The geometry and location of the dynamic lifting zone 250 is subject to real-time changes in boom and slew angles, as well as other factors. Briefly, FIG. 3C schematically illustrates a crane 30 with some crane parameters for use in dynamically determining the geometry and location of the dynamic lifting zone 250.

In general, various types of cranes 30 can be used. For example, the crane 30 can a pedestal crane having a revolving superstructure (with boom) bolted to a roller bearing. In another example, the crane 30 can be a kingpost crane having a stationary or fixed kingpost about which a revolving structure (with boom, machinery housing, hoist and slewing machinery, etc.) revolves. The crane 30 can have knuckled booms, latticed booms, etc. In general, the crane 30 can have suitable lifting capacities for offshore operations ranging as high as 300 metric tons, and the crane 30 can have boom lengths of any suitable length, such as up to 200 feet. Sensors can measure rope speed, slew angle position, boom angle, load, and other parameters of the crane 30.

Figure 3A:
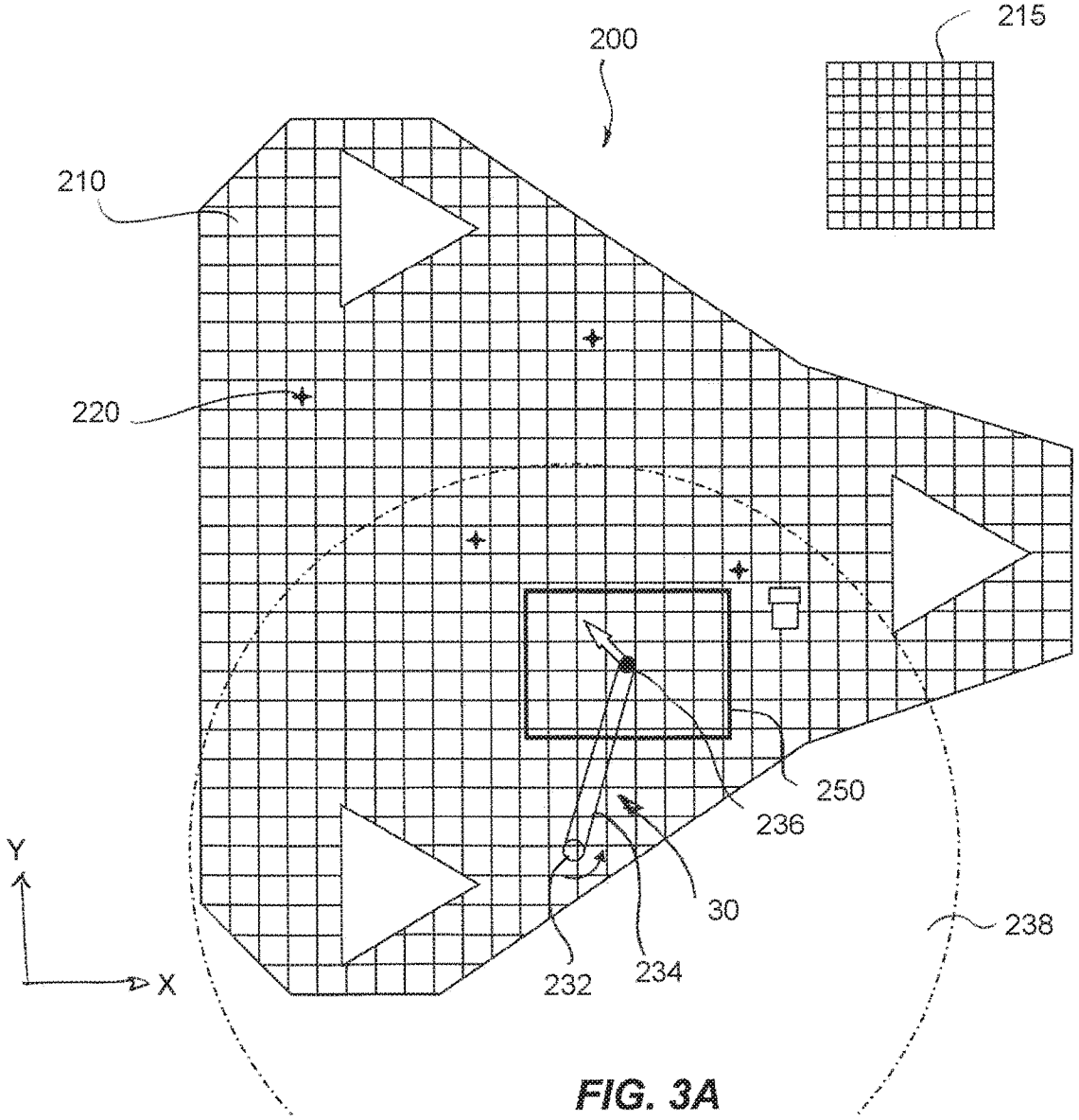
FIG. 3A diagrams a plan view of a dimensional map according to the present disclosure.
Figure 3B:
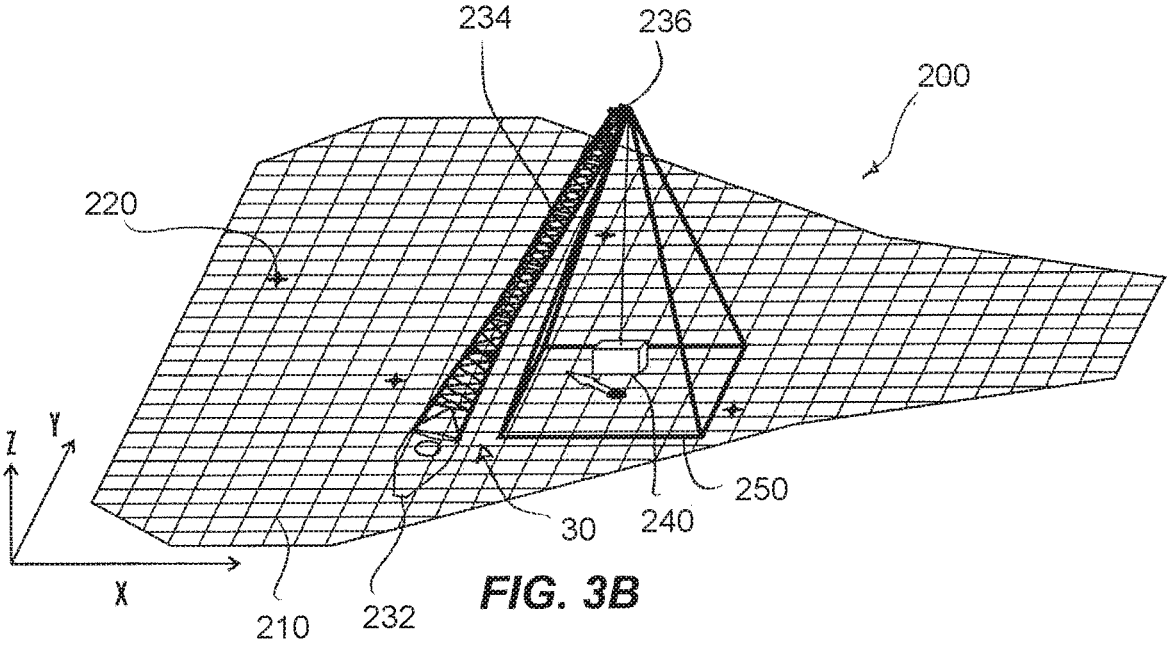
FIG. 3B diagrams a perspective view of the dimensional map according to the present disclosure.
Figure 3C:
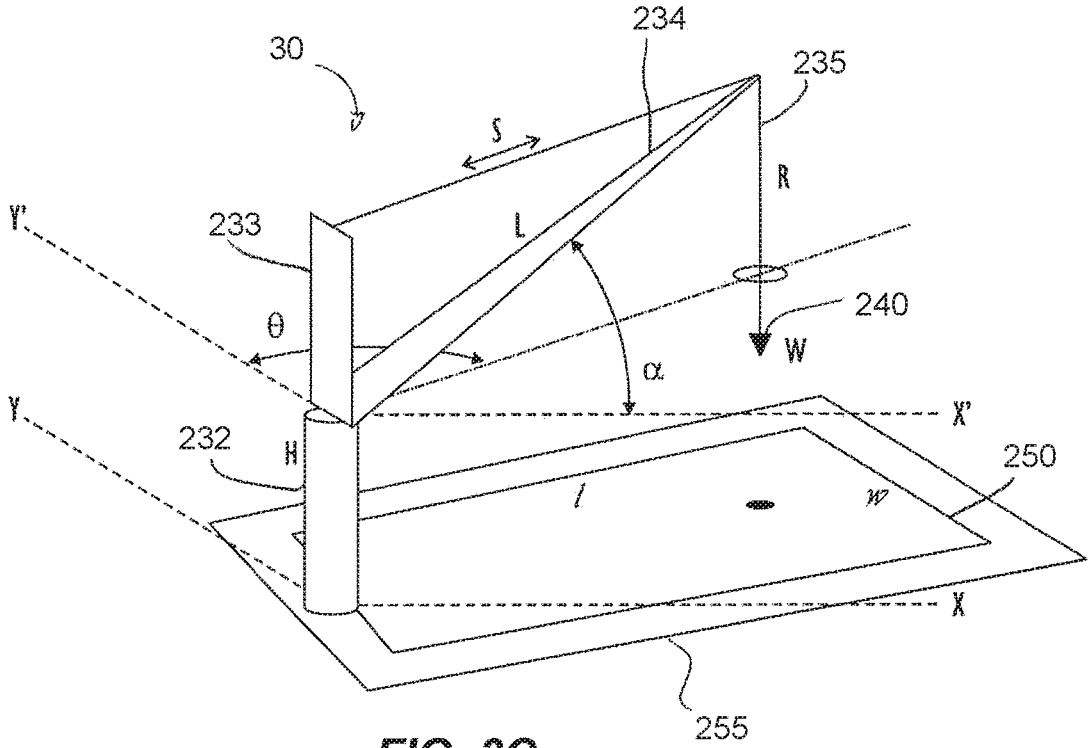
FIG. 3C schematically illustrates a crane with some crane factors for use in dynamic determining geometry and location of a zone according to the present disclosure.

The crane shown in FIG. 3C includes a pedestal 232 with a boom 234 mounted thereon. The boom 234 of the upper structure supports a hoist tackle (not shown) and is raised and lowered by a boom hoist 233, which uses wire ropes, sheaves, shafts blocks and other rigging to support the boom 234. The pedestal 232 typically has a height (H) above the platform (22) of the offshore unit (20). The boom 234 can rotate about the pedestal 232 to define a slew angle ($\theta$) relative to a reference (e.g., Y'-axis in FIG. 3C). The boom 234 can also be raised or lowered to define a boom angle ($\alpha$) relative to a reference plane (e.g., horizontal X'-Y' plane in FIG. 3C). Finally, the boom 234 can be extended or retracted to define a boom length (L).

In addition to slew angle ($\theta$), boom angle ($\alpha$), and boom length (L), other crane parameters can include hook load/weight (W), block height, alarms (e.g., boom limit, slew limit, overload), hoist speed (S), cable length (R), boom angle speed, slew angle speed, environmental data (e.g., wind speed), and other data. The crane instrumentation can provide these and a number of other crane parameters related to the operation of the crane 30.

In general and already noted above, the dynamic lifting zone 250 in FIGS. 3A-3C is defined within the static lifting zone 238 and includes the area under the crane boom 234 and its load 240. This zone 250 and its associated geometry moves with the crane boom 234 and its load 240 as lifting operations are undertaken. Although the dynamic lifting zone 250 can have any suitable boundaries, the geometry is preferably inclusive of the various loads 240 that could be lifted by the crane 30 in which the system is integrated. The dynamic lifting zone 250 can be circular and defined by a center point and a radius. Alternatively, the dynamic lifting zone 250 can be rectilinear and defined by at least a width (w) and a length (l), as represented in FIGS. 3A-3C. (A height could also be defined.)

For example, the width (w) of the zone's geometry can be a predetermined value and can move as a whole in real time with the slew angle ($\theta$) provided by the crane instrumentation to the system 100. The length (l) of the zone's geometry can have a predetermined lower limit that corresponds to the lowest possible operational boom angle ($\alpha$). The length (l) of the dynamic lifting zone 250 can be increased from this lower limit in real-time with changes of the boom angle ($\alpha$). As a result, the boom angle ($\alpha$) combined with physical boom length (L) define a hypotenuse, and the resulting length (l) for the dynamic lifting zone 250 represents the adjacent side of the resulting triangle. These inputs and associated calculations can thereby make up the geometric boundaries of the dynamic lifting zone 250.

As the crane (30) operates on the unit (20), the crane operator uses the information of the dimensional map 200, the located personnel (or equipment) 220, camera feeds, the dynamically moving dynamic lifting zone 250, and the like to monitor and control the crane's operation. In general, the information can indicate a conflict or interaction of located personnel (or equipment) 220 with the dynamic lifting zone 250, which may require some further action by the crane operator.

For example, personnel (or equipment) can be identified as authorized or unauthorized for specifically defined lifting zones 250 or other regions of the map 200. For example, the operator has the ability to provide "authorized" status to personnel that will be assisting with lifting operations. During the crane operation, the locations 220 of the personnel (or equipment) are tracked in real-time, and identifications of the tracked locations 220 can be associated with authorized or unauthorized status for the defined dynamic lifting zone 250. When unauthorized personnel enters the defined dynamic lifting zone 250 (or when the dynamic lifting zone 250 moves to encompass unauthorized personnel), the control system (100) can generate automated alarms and/or machine controls. Additionally, real-time visual indications of locations and other relevant lifting information can be overlaid on real-time camera views of the lifting operation provided to the crane operator. As noted herein, the detection of personnel (and equipment) in the dynamic lifting zone 250 can be determined manually or automatically based on load 240, direction, movement, and other noted parameters discussed herein.

As shown in FIGS. 3B-3C, the lifting zone under consideration may include an additional margin around the dynamic lifting zone 250 that will also move in conjunction with the dynamic lifting zone 250. As one example, the margin may encompass a dynamic warning zone 255, which can extend out approximately 20-ft or some other distance from the dynamic lifting zone 250 in all directions. The dynamic warning zone 255 may be extended in the direction of movement to provide advance warning.

Any unauthorized personnel (or equipment) that crosses the threshold of the dynamic warning zone 255 (or has the warning zone's threshold move to encompass it) can initiate an alarm that notifies the crane operator, the unauthorized personnel infringing the zone, and/or some other entity. In like manner, any unauthorized personnel (or equipment) that enters the dynamic lifting zone 250 (or has the lifting zone's threshold move to encompass it) can initiate a separate specific alarm that can notify these same parties.

Figure 4:
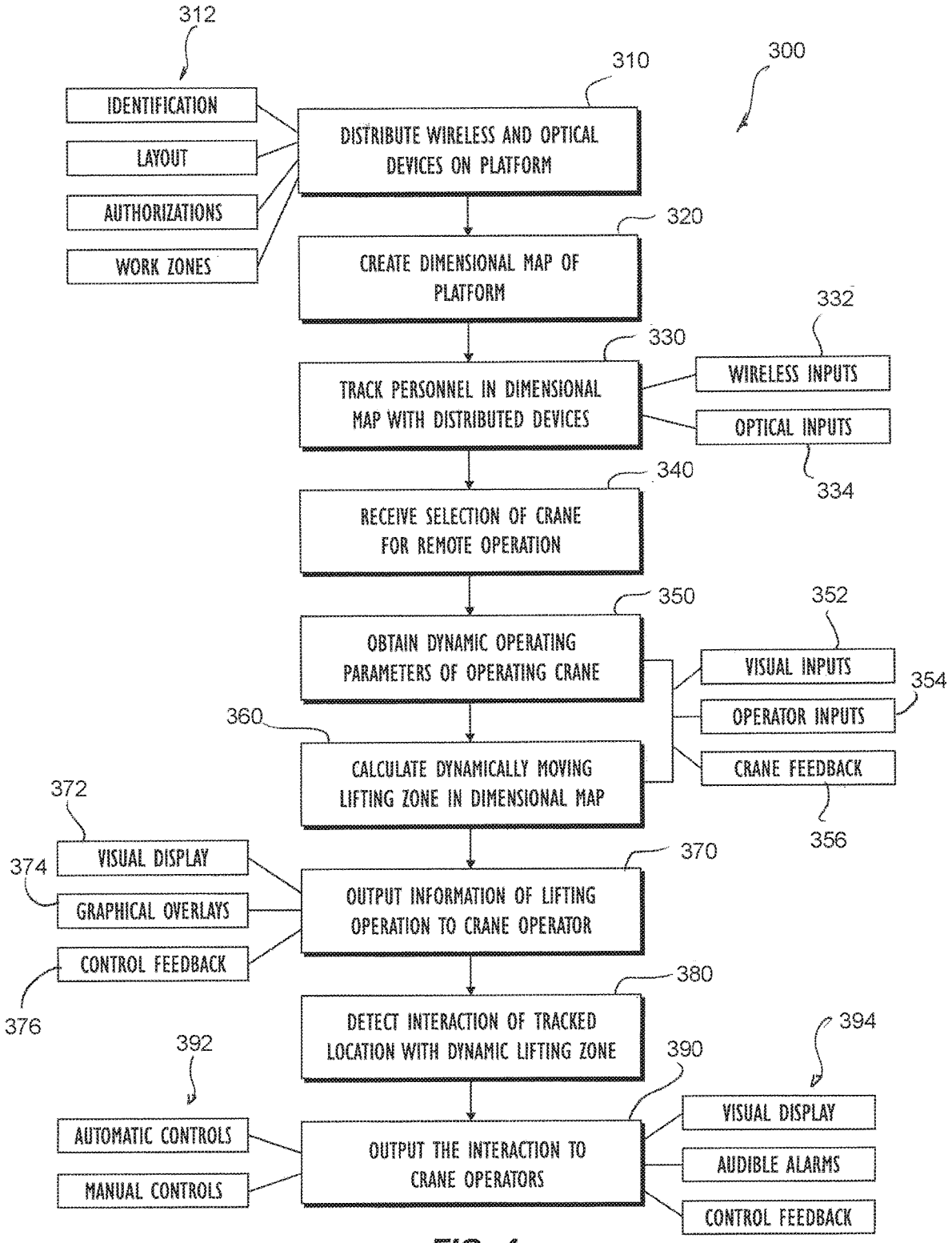
FIG. 4 illustrates a flow chart of operation of the disclosed system in remotely operating cranes according to the present disclosure.

With an overview of the control system 100 and its use, discussion turns to FIG. 4, which illustrates a flow chart of a process 300 of the disclosed system 100 in remotely operating cranes 30 according to the present disclosure. (For purposes of explanation, reference to elements in FIGS. 1, 2A-2B, and 3A-3C will be provided in the current discussion.)

To operate the cranes 30 on the offshore unit 20 on which personnel operate, the plurality of wireless devices 110, 120 are distributed (Block 310). Some of the devices 120 are portable and associated (e.g., worn, carried, etc.) by personnel (or attached to equipment). Other devices 110 are stationary and associated (e.g., mounted, etc.) on the unit 20.

In distributing the wireless devices 110, 120, the stationary devices 110 are arranged as access points with a configured layout on the unit 20 to cover various work areas, regions, and the like on the unit 20. As will be appreciated, the various work areas on the unit 20 may be used for different purposes and operations, such as pipe handling, pipe storage, fluid handling, etc. The portable wireless devices 120 can be beacons, transmitters, Bluetooth, RFID, cellular, or other like devices. In turn, the stationary wireless devices 110 can be access points, receivers, transceivers, and the like of for compatible wireless communication with the portable devices 120.

In addition to the wireless devices 110, 120, various optical devices 130, such as cameras, motion sensors, and the like, are distributed on the unit 20. The cranes 30 of the unit 20 can be outfitted with a number of cameras 130*b-c* for monitoring both the movement of the crane and for monitoring surroundings in the vicinity of the crane 30. Other optical devices 130*a*, such as cameras, motion sensor, and the like, can be arranged throughout the unit 20 to monitor work areas, regions, and the like. The optical devices 130 may operate in some areas as a primary form of monitoring personnel (or movable equipment), but may operate in other areas as a secondary form of monitoring that is ancillary to the wireless monitoring.

The devices 110, 120, and 130 are associated with database information (Block 312) of the control system 100. The database information (Block 312) can include information about the identity of the devices 110, 120, 130, personnel, locations, etc.; information about the layout of the devices 110, 120, 130; information about personnel authorizations; and information about work areas or other regions of the unit 20.

For example, the portable devices 120 for the personnel are associated with identifying information (e.g., worker ID, name, position, etc.) and with particular authorizations for the personnel. Thus, a given personnel member may or may not be authorized to access or work in various areas or regions on the unit 20, and information on such authorizations can be stored in the control system 100 and associated with the personnel's identification.

From the layout and monitoring, the dimensional map 200 of the offshore unit 20 is created in the control system 100 (e.g., in a database) (Block 320). The dimensional map 200 can be two-dimensional, although three dimensions may be preferred because the unit 20 has three-dimensional features and the crane 30 operates in three dimensions.

With the distributed devices 110, 120, and 130 and with the created dimensional map 200, locations 220 of the personnel are tracked in the dimensional map 200 of the database (Block 330). To do this, wireless monitoring is received in the form of wireless inputs (Block 332) from the wireless devices 110, 120 associated with the personnel and the offshore unit 20. Visual monitoring can also be received in the form of optical input (Block 334) from the optical devices 130 of cameras, motion sensors, and the like.

The tracking involves the portable wireless device 120 of the personnel wirelessly interacting with one or more stationary devices 110 distributed on the unit 20. The wireless interaction can involve communication of identifying information, such as ID number, signal strength, access point location, and the like, which is associated in the database with given information of the personnel, dimensional map 200, etc. For example, the portable device 120 of a personnel member in a zone on the unit 20 may wirelessly interact with two or more stationary devices 110 with known locations on the unit 20. Using triangulation, comparison of signal strengths between stationary devices 110, and other locating techniques, the location of the portable device 120 can be indicated in the dimensional map 200 of the unit 20. The personnel (or equipment) associated with the portable device 120 can be identified and authorizations accessed.

As a backup to the wireless monitoring or in place of the wireless monitor, visual monitoring with the optical devices 130 of cameras, motion sensors, and the like can be used for tracking locations 220 of personnel and equipment in the dimensional map 200 of the unit 20. Personnel and equipment, whether wirelessly monitored or not, can also be tracked in this manner. For example, personnel may not currently have a portable wireless device 120, the portable device 120 may not be interacting properly, a particular zone may not have stationary wireless devices 110, or some other reason may apply. The visual monitoring can be used in these and other situations.

The tracking (Block 330) can be continuous with repeated monitoring and updating in real time. Such tracking has benefits on its own in monitoring various operations on the unit 20. According to the present disclosure, crane operations are one form of operation suitable for monitoring in this manner. As noted above, the unit 20 may have one or more cranes 30, and a crane operator can operate a selected one of the cranes 30 from a remote station 150 on the unit 20. Such a remote station 150 includes various controls, inputs, displays, and the like allowing the remote crane operator to operate the selected crane 30 with the monitoring disclosed herein. Alternatively, the crane operator can operate a selected crane 30 from a conventional crane cab augmented with various controls, inputs, displays, and the like for the monitoring disclosed herein. Ideally, when one of the cranes 30 is selected for operation by the operator, simultaneous operation of any of the other cranes 30 is restricted, although this may not be necessary in some implementations.

To perform a crane operation remotely, the crane operator selects a crane 30 for remote operation (Block 340). The control system 100 (e.g., a programmable control device of the system 100) then obtains dynamic operating parameters of the crane 30 operating on the offshore unit 20 (Block 350). The dynamic operating parameters can include visual inputs (Block 352) from cameras 130 associated with the crane 30 and surrounding area, communications from personnel on the unit 20 and other control stations 60, locations 220 of personnel in the dimensional map 200, identification of the personnel, visual boundaries of zones in the dimensional map 200, and other information. Wireless inputs associated with the movement and operation of the crane 30 may also be obtained if so arranged.

The dynamic operating parameters include operator inputs (Block 354) from the crane operator and include feedback (Block 356) from equipment of the crane 30. For example, the operator uses joysticks and other inputs (Block 354) to direct and control operation of the crane 30, such as to rotate the crane 30, to raise and lower the boom 234, to lift and lower a load 240, and the like. In turn, the crane 30 provides feedback (Block 356) of its operation, including information from sensors and instrumentation of the crane 30 and its component, indicating information such as the crane's slew angle, boom angle, lift height, speed, load, position, direction, etc.

As noted herein, the crane 30 can also include a camera 130*c* on the end of the boom 234 for visually monitoring the unit 20 below. Other cameras 130 can externally monitor the motion and position of the crane 30 relative to the unit 20. For the dynamic operating parameters of the crane 30, visual monitoring at least in the vicinity of the crane 30 operating on the unit 20 can be received to determine the dynamic movement of the crane 30, the position of boom 234, the position of the load 240, etc. The crane 30 itself may have internal sensors and instrumentation for monitoring its position, motion, and other operational details.

From the received controls and feedback, the control system 100 determines dynamic operating parameters of the crane 30 and its components in the dimensional map 200. From these dynamic operating parameters, the control system 100 calculates the dynamic lifting zone 250 of the crane 30 moving dynamically in the dimensional map 200 in the database (Block 360). As noted above, this dynamic lifting zone 250 represents a bounded region in the crane's range, below the boom 234, underneath the load 240, etc. subjected to monitoring as the crane 30 operates and moves during operation. In calculating the dynamic lifting zone 250, the dynamic movement of the crane's operation is dimensionally translated into one or more boundaries of the dynamic lifting zone 250 within the dimensional map 200. The dynamic lifting zone 250 can be defined and moved in two or more dimensions of the dimensional map 200.

During the operation, the control system 100 outputs information of the lifting operation to the crane operator (Block 370). For example, the output can take the form of visual display (Block 372) of camera feeds, including multiple views and picture-in-picture. Graphical overlays (Block 374) can be included into the visual displays (Block 372) to depict the dynamic lifting zone 250, the dynamic parameters of the crane 30, information of located personnel 220, numerical values of the crane's operation, etc. Control feedback (Block 376) may also be output.

During the course of monitoring and operating, the control system 100 may detect interaction of the tracked locations 220 of the personnel (or equipment) interfering with the dynamically moving dynamic lifting zone 250 (Block 380). For example, the control system 100 may detect a conflict in which at least one of the tracked locations 220 of the personnel (or equipment) interferes with the dynamically moving dynamic lifting zone 250 of the crane 30 operating on the unit 20. As a result, the control system 100 may output the interaction (e.g., conflict) to the operator or to the crane 30 (Block 390) in the form of an alarm, automatic control, etc.

In general, the control system 100 may determine that the at least one tracked location 220 of the personnel is located (or will be located) at a point-in-time within a boundary of the dynamically moving dynamic lifting zone 250 in the dimensional map 200. In turn, the control system 100 can generate a control (Block 392) and/or a perceptible representation (Block 394).

In response to the conflict, for example, automated or manual controls (Block 392) may be initiated in the crane operations. Automated control can include stopping, slowing, or changing the crane operations to avoid the conflict. Such automated control may not be suitable in all circumstances, especially when a load is being moved. For this reason, any number of manual controls may be available to the crane operator in response to the conflict to stop, slow, or change the crane operations.

In response to the conflict, the perceptible representations (Block 394) can be output to the crane operator, the personnel on the unit 20, and elsewhere. A visual display, an alarm, instruction, control feedback, or the like may be sent via the communication interface from the control system 100 to the crane operator, the interfering personnel, and others using an appropriate form of communication.

Various features of the control system 100 have been detailed above. Discussion now turns to FIGS. 5A-5B, which illustrate schematic views of a control system 100 according to the present disclosure.

Figure 5A:
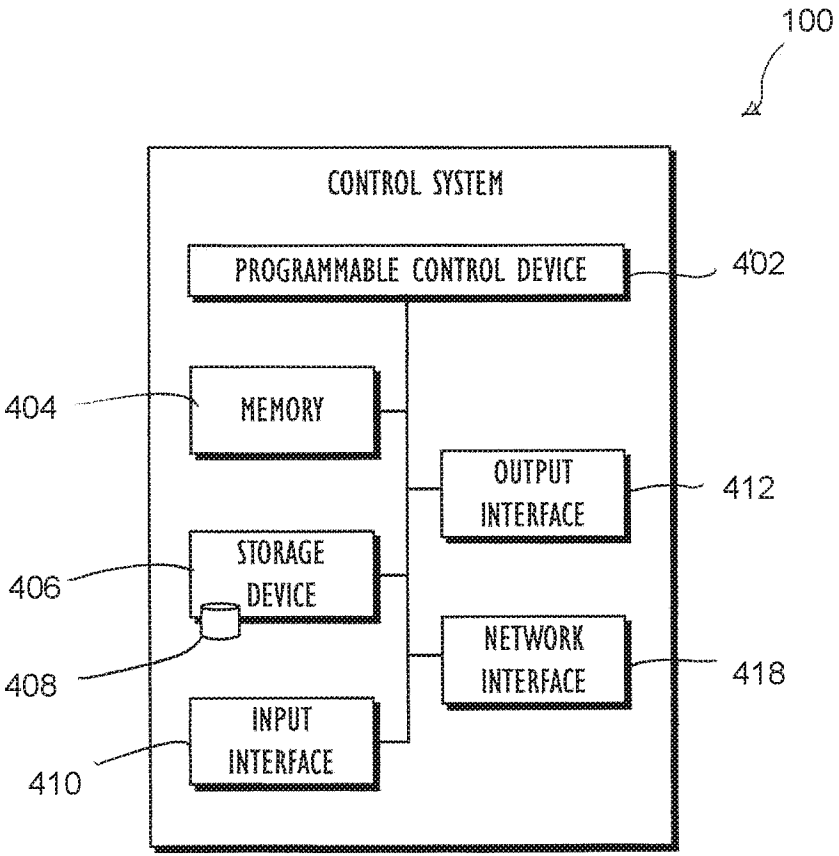
FIGS. 5A-5B illustrate schematic views of an operational system according to the present disclosure.

Referring to structural elements as shown in FIG. 5A, the control system 100 includes a programmable control device 402, which can use any suitable computing hardware and software, including one or more of programmable logic controls, communication switches, servers, computers, etc. For example, the programmable control device 402 can include distributed computer resources of programmable logic controls, communication switches, servers, computers, etc. As shown in FIG. 5A, the programmable control device 402 is in operable communication with memory 404, storage device(s) 406, input interfaces 410, output interfaces 412, and network interfaces 418. These structural elements can use any suitable hardware and software for operating the cranes according to the techniques disclosed herein. Database(s) 408 store a dimensional map of the offshore unit (20)

in which the stationary devices (110) and the optical devices (130) are laid out and in which the portable devices (120) are tracked.

Figure 5B:
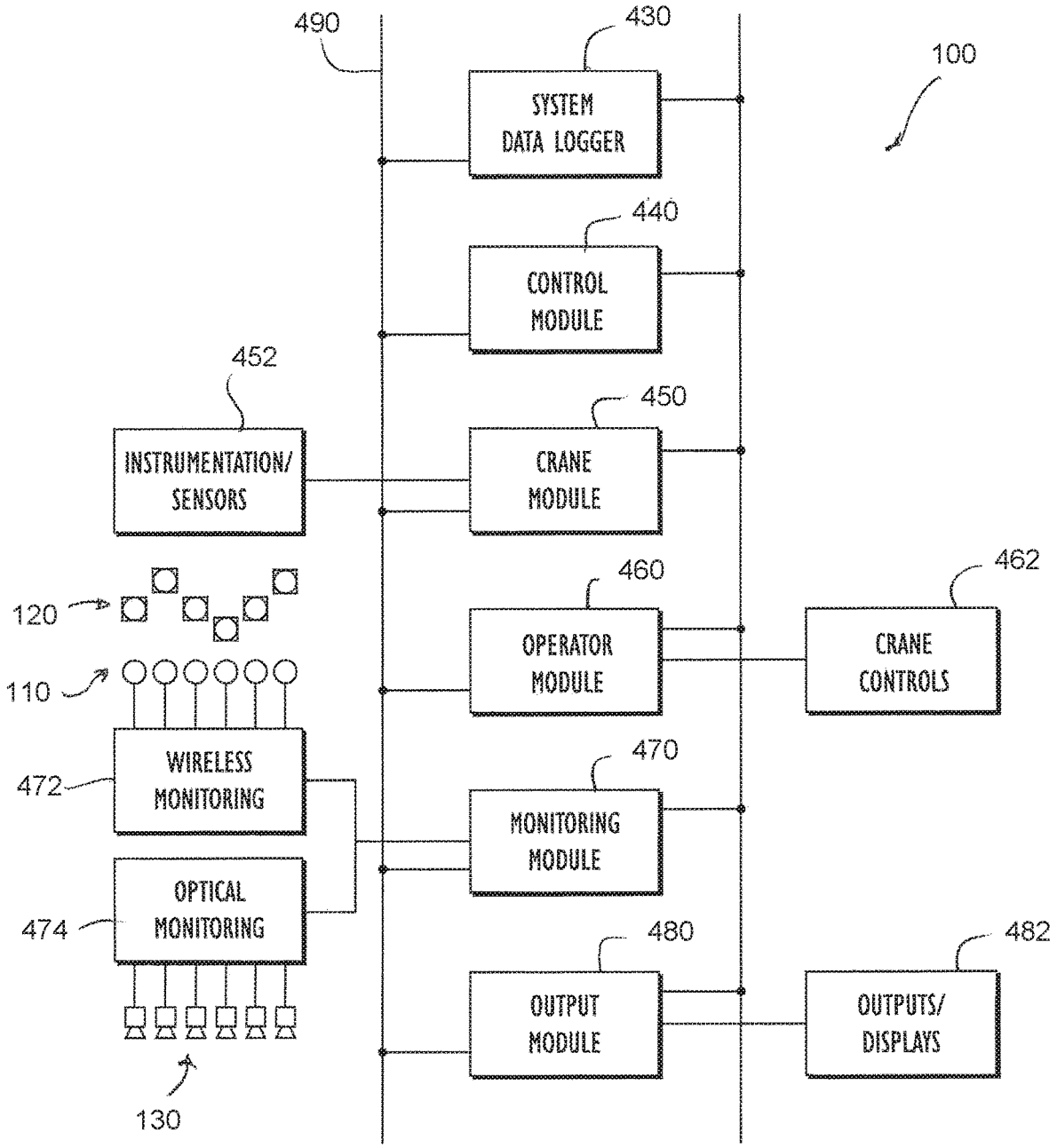

FIG. 5B schematically illustrates further details of the control system 100, which can include a system data logger 430, a control module 440, a crane module 450, an operator module 460, a monitoring module 470, and an output module 480. As will be appreciated, the modules can be implemented using combinations of structural and functional elements in hardware and software.

The modules are in communication with one another via a communication bus 490. The system data logger module 430 can log data of the system 100 and its operation in databases of storage devices and the like. The control module 440 operates as the main control or hub for coordinating operation and interaction of the various modules and structural elements (FIG. 5A) of the control system 100.

The other modules are responsible for interaction with operational aspects of the system 100 and communicate with external modules, components, and equipment. For example, the crane module 450 is in communication with instrumentation, sensors, and other crane components 452 of the crane equipment on the unit (20). The crane module 450 thereby sends and receives communications associated with the control and operation of the cranes (30).

The operator module 460 is in communication with crane controls 462, such as the joystick and other control equipment used by an operator in a remote station (150 or local cab) to operate the cranes. The operator module 460 is thereby responsible for exchanging suitable information for the crane operator to perform crane operations.

The monitoring module 470 is in communication with the wireless monitoring equipment 472 and optical monitoring equipment 474. The monitoring module 470 is thereby responsible for exchanging suitable information for monitoring and tracking crane operations. As noted herein and presented again here, the wireless monitoring equipment 472 includes an array of stationary wireless devices 110, such as wireless Bluetooth access points, RFID transceivers, and the like, which interact wirelessly with portable wireless devices 120. Likewise, the optical monitoring equipment 474 includes an array of optical devices 130, such as cameras, motion detectors, and the like, and receives optical monitoring in the form of video feeds, pictures, motion detection, and the like.

Finally, the output module 480 is in communication with outputs and displays 482 for presentation to the crane operator in the remote station. The output module 480 is thereby responsible for exchanging suitable communication information for the crane operator to perform crane operations.

The information provided to the crane operator by the control system 100 can augment camera views and can provide graphic rendering of the crane mapped with the static lifting areas (238), the dynamic lifting and warning zones 250 and 255, camera feeds, and crane instrumentation. The control system 100 receives various inputs (e.g., position coordinates, instrumentation feeds, alarm status, etc.), visually maps out the areas exposed to the crane operations, and provide graphic overlays and other user interfaces for the crane operator.

For example, the coordinates of the dynamic lifting zone (250) are passed on in real-time to an output module 150 of the system 100. In turn, output module 480 can use these coordinates to render a transparent red boundary on the display screens displaying various feeds from multiple camera angles to the crane operator. As noted above, the cameras (130*b-c*) can be located to provide a display on multiple screens that mimics the viewpoint of local operation from a local crane cab. This graphical rendering can be turned on or off by the operator.

The coordinates of the dynamic warning zone (255) can also be passed on in real-time to the output module 480 of the control system 100. In turn, the output module 480 can use these coordinates to render a transparent yellow boundary outside of the dynamic lifting zone's red boundary on to the display screens displaying the various feeds from multiple camera angles.

When the control system 100 determines an alarm status indicating an unauthorized personnel violation of the dynamic lifting or warning zone (250 or 255), the output module 480 can place an alarm banner on the screen for the operator and can also stop the crane operation. The violating unauthorized person's identification and location information can also be provided in the alarm.

In addition to these features, the output module 480 can provide various meters, dials, and readouts indicating various items of crane status. For example, slew angle, boom angle, block height, hook load, anti-two block status, hoist speed, and associated alarm status with these indications can be provided on the graphical display by the output module 480 to the operator. These meters/dials/readouts may be semi-transparent overlays on the camera feeds used by the operator to conduct lifting operations. The output module 480 can provide picture-in-picture views on one screen from any two cameras (130).

Figure 6:
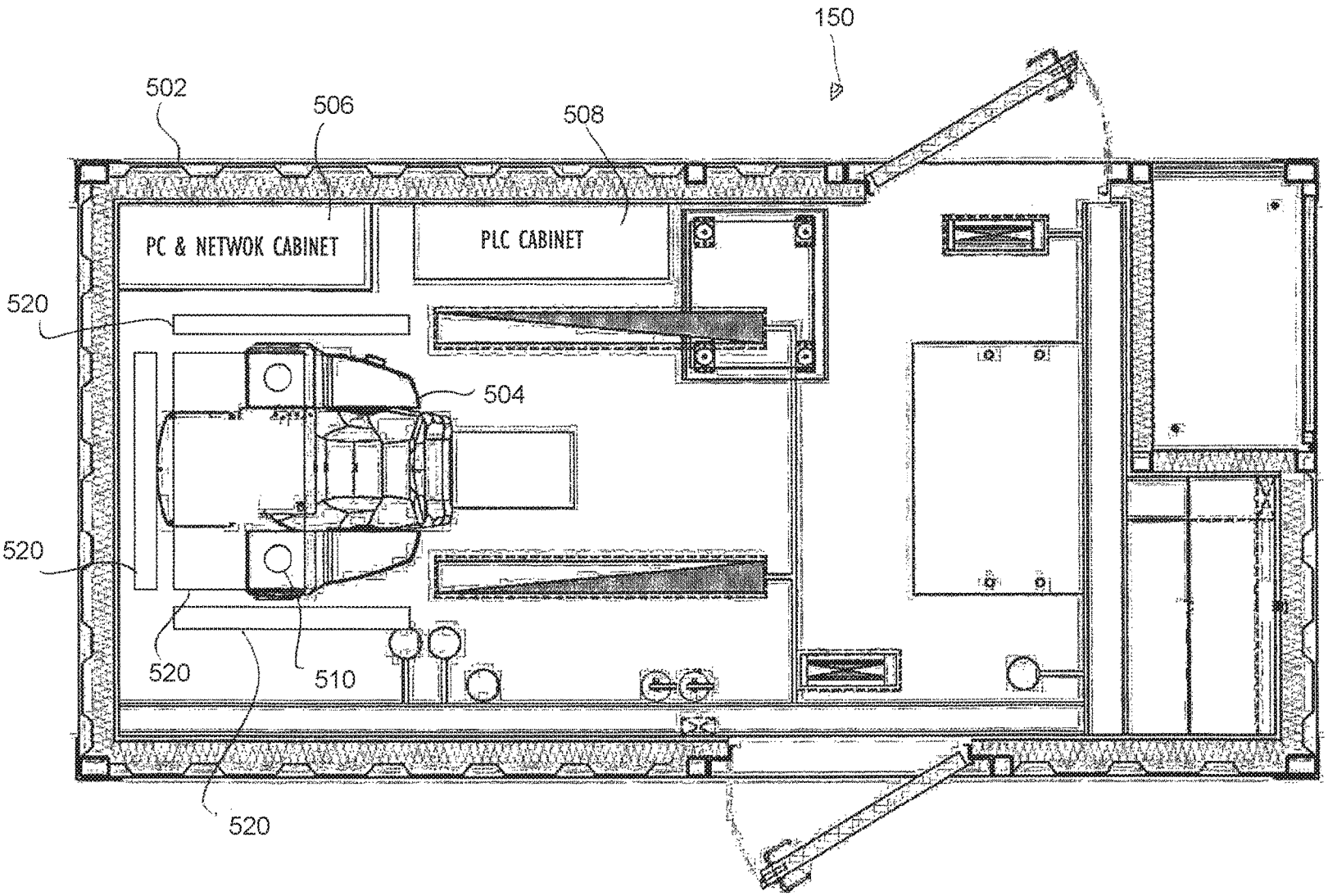
FIG. 6 illustrates a plan view of a remote crane station for the disclosed system according to the present disclosure.

The remote control station 150 has been briefly detailed above. Discussion now turns to FIG. 6, which illustrates a plan view of a remote control station 150 for the disclosed system according to the present disclosure. The control station 150 is located in a remote location to provide a single operator the ability to control any crane 30 from a single location. The station 150 preferably allows the operator to operate a single crane 30 at a time. Camera feeds, controls, and instrumentation are switched in unison from any crane 30 to the remote crane station 150.

The station 150 includes a suitable enclosure 502 for use on the offshore unit (20) with appropriate hazard detection, climate features, and the like. A control station 504 inside the enclosure 502 includes crane controls 510, such as joysticks, input panels, and the like. Displays 520 provide an immersive view for the operator at the control station 504. As shown, at least four displays can be arranged around the crane operator's control chair to mimic the view the operator would otherwise have in the local crane cab.

Any number of hardware and software components of the control system can be housed in the control station 150. For example, the station 150 can include a cabinet 506 for programmable logical controls and a cabinet 508 for computing and networking components. In the end, the station 150 allows the operator to switch between cranes for control, monitoring, and operation.

As noted herein, for example, real-time information of lifting zones, personnel identification, and location is integrated into the operator's interface by augmenting and overlaying the real-time camera views to enhance the operator's awareness of lifting operations. All the potential lifting areas of the remotely operated cranes are digitally mapped, and a combination of visual and wireless monitoring provide real-time location and identification of personnel who enter digitally mapped lifting areas. For example, the dynamic lifting zone and any other associated areas can have a semi-transparent red and yellow overlay that are superimposed on the operator's camera feed on the displays. This will provide a visual representation of the zones in real time for the operator. Meters and digital readouts of various crane functions can also have a semi-transparent overlay superimposed on the operators camera feed. Any of the visual overlays can be configured and turned on or off at the preference of the operator.

In addition to monitoring crane operations, the mapping, personnel identification, and tracking can also be used for other purposes. For example, "restricted areas" can be mapped, and unauthorized entrance into these areas can initiate an alarm. Infractions of the "restricted areas" by personnel can be logged and tracked in conjunction with the personnel's identification. In another example, muster stations on the unit can automatically detect personnel present and can automatically populate a logbook.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A computer-implemented method of operating a crane on an offshore unit on which entities operate, the method comprising:

creating, in a database, a dimensional map of the offshore unit;

tracking, in the database, locations of the entities in the dimensional map of the offshore unit by receiving at least wireless monitoring from wireless devices associated with both the entities and the offshore unit;

obtaining, with a programmable control device, dynamic operating parameters of the crane operating on the offshore unit;

calculating, with the programmable control device, a dynamic lifting zone that changes by moving dynamically in the dimensional map in the database based on the dynamic operating parameters of the crane;

detecting, with the programmable control device, a conflict of at least one of the tracked locations interfering with the dynamic lifting zone of the crane; and outputting the detected conflict with the programmable control device.

2. The method of claim 1, wherein creating, in the database, the dimensional map of the offshore unit comprises creating a three-dimensional map.

3. The method of claim 1, wherein receiving at least the wireless monitoring from the wireless devices associated with both the entities and the offshore unit comprises receiving indication of the entities from portable ones of the wireless devices associated with the entities at one or more of a plurality of stationary ones of the wireless devices associated with the offshore unit.

4. The method of claim 1, wherein tracking, in the database, the locations of the entities in the dimensional map of the offshore unit further comprises receiving visual monitoring from visual devices associated with the offshore unit.

5. The method of claim 1, wherein detecting, with the programmable control device, the conflict of at least one of the tracked locations interfering with the dynamic lifting zone of the crane operating on the offshore unit comprises determining that the at least one tracked location is located at a point-in-time within a boundary of the dynamic lifting zone in the dimensional map.

6. The method of claim 1, wherein outputting the conflict with the programmable control device comprises generating a perceptible representation of the conflict and outputting the perceptible representation from an interface of the programmable control device to an operator of the crane.

7. The method of claim 1, wherein outputting the conflict with the programmable control device comprises generating a control in response to the conflict; and controlling the operation of the crane with the generated control.

8. The method of claim 1, wherein obtaining, with the programmable control device, dynamic operating parameters of the crane operating on the offshore unit comprises selecting, with the programmable control device, the crane for remote operation from a plurality of cranes on the offshore unit.

9. The method of claim 8, wherein selecting, with the programmable control device, the crane for remote operation comprises restricting operation of any other of the cranes for simultaneous operation.

10. The method of claim 1, wherein obtaining, with the programmable control device, the dynamic operating parameters of the crane operating on the offshore unit comprises receiving control of the crane from an operator; receiving feedback from equipment of the crane; and determining dynamic movement of the crane relative to the dimensional map from the received control and feedback.

11. The method of claim 10, wherein receiving the control of the crane from the operator comprises receiving the control at a location remote from the crane.

12. The method of claim 10, wherein the dynamic movement of the crane comprises one or more of slew angle, boom angle, boom length, hook load, weight, block height, boom limit, slew limit, overload, hoist speed, cable length, boom angle speed, slew angle speed, and environmental data.

13. The method of claim 10, wherein obtaining, with the programmable control device, the dynamic operating parameters of the crane operating on the offshore unit further comprises receiving visual monitoring at least in a vicinity of the crane operating on the offshore unit; and determining the dynamic movement of the crane relative to the dimensional map from the received visual monitoring.

14. The method of claim 10, wherein calculating, with the programmable control device, the dynamic lifting zone of the crane that changes by moving dynamically in the dimensional map in the database based on the dynamic operating parameters of the crane comprises dimensionally translating the dynamic movement of the crane into one or more boundaries of the dynamic lifting zone within the dimensional map.

15. A computer-implemented method of operating a crane on an offshore unit on which entities operate, the method comprising:

creating, in a database, a dimensional map of the offshore unit;

tracking, in the database, locations of the entities in the dimensional map of the offshore unit by receiving at least wireless monitoring from wireless devices associated with both the entities and the offshore unit;

obtaining, with a programmable control device, dynamic operating parameters of the crane operating on the offshore unit;

calculating, with the programmable control device, a lifting zone moving dynamically in the dimensional map in the database based on the dynamic operating parameters of the crane;

detecting, with the programmable control device, a conflict of at least one of the tracked locations interfering with the dynamically moving lifting zone of the crane; and outputting the detected conflict with the programmable control device, wherein tracking, in the database, the locations of the entities in the dimensional map of the offshore unit further comprises identifying given ones of the entities as authorized and unauthorized for the tracked locations in the dimensional map.

16. A system for operating a crane on an offshore unit on which entities operate, the system comprising:

a plurality of portable wireless devices associated with the entities;

a plurality of stationary wireless devices associated with the offshore unit;

a database storing a dimensional map of the offshore unit;

a communication interface in communication with the plurality of stationary wireless devices and with the crane; and a programmable control device in communication with database and the communication interface, the programmable control device configured to:

track, in the database, locations of the entities in the dimensional map of the offshore unit by receiving at least wireless monitoring from the wireless devices associated with the entities and the offshore unit;

obtain dynamic operating parameters of the crane operating on the offshore unit;

calculate a dynamic lifting zone that changes by moving dynamically in the dimensional map in the database based on the dynamic operating parameters of the crane;

detect a conflict of at least one of the tracked locations interfering with the dynamic lifting zone of the crane; and output the detected conflict.

17. The system of claim 16, further comprising a plurality of visual devices associated with the offshore unit, the visual devices receiving visual monitoring and in communication with the interface.

18. The system of claim 17, wherein the programmable control device is configured to track, in the database, the locations of the entities in the dimensional map of the offshore unit based on the received visual monitoring.

19. The system of claim 17, wherein the programmable control device is configured to determine dynamic movement of the crane relative to the dimensional map from the received visual monitoring at least in a vicinity of the crane operating on the offshore unit.

20. The system of claim 16, comprising:

an operator module in communication with the interface and receiving control of the crane from an operator; and a crane module in communication with the interface and receiving feedback from equipment of the crane.

21. The system of claim 20, wherein to calculate the dynamic lifting zone in the dimensional map, the programmable control device is configured to:

determine dynamic movement of the crane relative to the dimensional map from the received control and feedback, and dimensionally translate the dynamic movement of the crane into one or more boundaries of the dynamic lifting zone within the dimensional map.

* * * * *